US007263171B2

(12) United States Patent
Zhang

(10) Patent No.: US 7,263,171 B2
(45) Date of Patent: Aug. 28, 2007

(54) BEAM DIAPHRAGM AND X-RAY IMAGING APPARATUS

(75) Inventor: Chen Zhang, Beijing (CN)

(73) Assignee: GE Medical Systems Global Technology Company, LLC, Waukesha, WI (US)

( * ) Notice: Subject to any disclaimer, the term of this patent is extended or adjusted under 35 U.S.C. 154(b) by 44 days.

(21) Appl. No.: 11/243,696

(22) Filed: Oct. 5, 2005

(65) Prior Publication Data

US 2006/0083352 A1 Apr. 20, 2006

(30) Foreign Application Priority Data

Oct. 15, 2004 (CN) ..... 2004 1 0085670

(51) Int. Cl.
*G21K 1/04* (2006.01)

(52) U.S. Cl. ..... 378/160; 378/147; 378/150; 378/151; 250/505.1

(58) Field of Classification Search ..... 378/145, 378/147, 150–153, 156–160; 250/505.1
See application file for complete search history.

(56) References Cited

U.S. PATENT DOCUMENTS 3,980,407 A * 9/1976 Hill ..... 355/71
4,752,947 A 6/1988 Telorack
5,086,444 A 2/1992 Bartmann
5,260,984 A 11/1993 Horbaschek
5,287,396 A 2/1994 Stegehuis
5,689,544 A 11/1997 Van Den Besselaar
5,953,550 A * 9/1999 Aoshima ..... 396/458
5,991,362 A 11/1999 Jones
6,233,303 B1 5/2001 Tam
6,778,636 B1 8/2004 Andrews

* cited by examiner

*Primary Examiner*—Allen C. Ho
(74) *Attorney, Agent, or Firm*—Armstrong Teasdale LLP

(57) ABSTRACT

With a view to providing a beam diaphragm having a large maximum value of aperture opening under a limited profile dimension, the beam diaphragm comprises a pair of control rings having coaxial apertures for the passage of X-rays therethrough and being opposed to each other axially through a spacing and coaxially rotatable independently of each other, a blade positioned between the pair of control rings, and position adjusting means which, in accordance with a relative rotation of the pair of control rings, causes the blade to move toward or away from a common axis of the apertures so as to describe a sectorial plane whose radius increases or decreases continuously.

10 Claims, 7 Drawing Sheets

BEAM DIAPHRAGM AND X-RAY IMAGING APPARATUS

CROSS REFERENCE TO RELATED APPLICATIONS

This application claims the benefit of Chinese Application No. 2004-10085670.4 filed Oct. 15, 2004.

BACKGROUND OF THE INVENTION

The present invention relates to a beam diaphragm and an X-ray imaging apparatus. Particularly, the present invention is concerned with a beam diaphragm for radiating X-rays emitted from an X-ray source to a subject through apertures, as well as an X-ray imaging apparatus provided with the beam diaphragm.

In an X-ray imaging apparatus, X-rays emitted from an X-ray source are radiated to a subject through apertures of a beam diaphragm. The beam diaphragm includes two control rings having apertures of a common axis and being opposed to each other axially through a spacing and rotatable independently of each other, a blade positioned between the two control rings, and position adjusting means which causes the blade to move toward or away from the axis of the apertures in accordance with a difference in rotation between the two control rings (see, for example, Patent Literature 1).

[Patent Literature 1]

U.S. Pat. No. 5,689,544 (Columns 3 to 5, FIGS. 1 and 2)

In the above beam diaphragm, the degree of opening of each aperture decreases when the blade is moved toward the axis of the apertures, and increases when the blade is moved away from the aperture axis.

Therefore, the degree of opening of each aperture becomes maximum when the blade is moved remotest from the axis of the apertures. It is desirable that a maximum value of aperture opening be as large as possible under a limited profile dimension of the beam diaphragm.

SUMMARY OF THE INVENTION

Therefore, it is an object of the present invention to provide a beam diaphragm wherein a maximum value of aperture opening is large under a limited profile dimension, as well as an X-ray imaging apparatus provided with such a beam diaphragm.

(1) In one aspect of the present invention for solving the above-mentioned problem there is provided a beam diaphragm comprising a pair of control rings having coaxial apertures for the passage of X-rays therethrough, the pair of control rings being opposed to each other axially through a spacing and coaxially rotatable independently of each other, a blade positioned between the pair of control rings, and position adjusting means which, in accordance with a relative rotation of the pair of control rings, causes the blade to move toward or away from a common axis of the apertures so as to describe a sectorial plane whose radius increases or decreases continuously.

(2) In another aspect of the present invention for solving the above-mentioned problem there is provided an X-ray imaging apparatus for photographing a radioscopic image by radiating X-rays emitted from an X-ray source to a subject through apertures of a beam diaphragm, the beam diaphragm comprising a pair of control rings having coaxial apertures for the passage of X-rays therethrough, the pair of control rings being opposed to each other axially through a spacing and coaxially rotatable independently of each other, a blade positioned between the pair of control rings, and position adjusting means which, in accordance with a relative rotation of the pair of control rings, causes the blade to move toward or away from a common axis of the apertures so as to describe a sectorial plane whose radius increases or decreases continuously.

For adjusting the position of the blade appropriately, it is preferable for the position adjusting means to comprise a first groove radially formed outside the aperture in one of the pair of control rings, a second groove arcuately formed outside the aperture in the other control ring, a first pin for bringing one end portion of the blade into engagement with the first and second grooves simultaneously, and a second pin provided on the other control ring, an opposite end portion of the blade being brought into engagement with the second pin through a longitudinal slot formed in the opposite end portion.

It is preferable that a planar shape of the blade be symmetric right and left with respect to a center line. This is because a maximum value of aperture opening can be made larger easily.

It is preferable that the thickness of the blade decrease gradually toward both right and left sides. This is because the amount of X-rays absorbed decreases gradually.

It is preferable that the decrease in thickness of the blade be asymmetric right and left. This is because the absorption of X-rays becomes asymmetric right and left.

In each of the above aspects the beam diaphragm comprises a pair of control rings having coaxial apertures for the passage of X-rays therethrough, the pair of control rings being opposed to each other axially through a spacing and coaxially rotatable independently of each other, a blade positioned between the pair of control rings, and position adjusting means which, in accordance with a relative rotation of the pair of control rings, causes the blade to move toward or away from the axis of the apertures so as to describe a sectorial plane whose radius increases or decreases continuously. Thus, it is possible to provide a beam diaphragm wherein a maximum value of aperture opening is large under a limited profile dimension, as well as an X-ray imaging apparatus provided with such a beam diaphragm.

Further objects and advantages of the present invention will be apparent from the following description of the preferred embodiments of the invention as illustrated in the accompanying drawings.

DETAILED DESCRIPTION OF THE INVENTION

Figure 1:
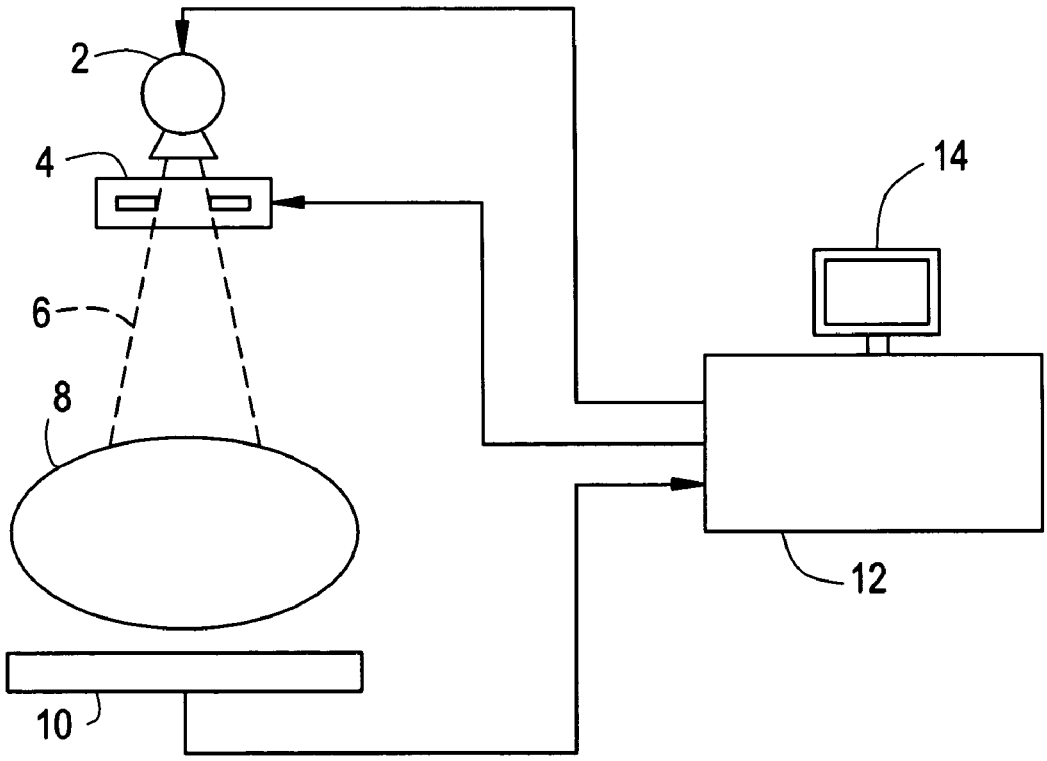
FIG. 1 is a diagram showing the construction of an X-ray imaging apparatus according to an example of the best mode for carrying out the present invention.

A best mode for carrying out the present invention will be described hereinunder with reference to the drawings. The present invention is not limited to the best mode for carrying out the invention. FIG. 1 shows the construction of an X-ray imaging apparatus. This apparatus is an example of the best mode for carrying out the invention. By the construction of this apparatus there is shown an example of the best mode for carrying out the present invention related to the X-ray imaging apparatus.

In this apparatus, as shown in the same figure, X-rays 6 emitted from an X-ray source 2 are radiated to a subject 8 through apertures of a beam diaphragm 4. Then, transmitted X-rays are received by an X-ray receiving panel 10 and a received light signal is processed in a photographing console 12 to reconstruct a radioscopic image of the subject 8. This radioscopic image thus reconstructed is displayed on a display 14 of the photographing console 12. The console 12 also functions to control the X-ray source 2 and the beam diaphragm 4.

Figure 2:
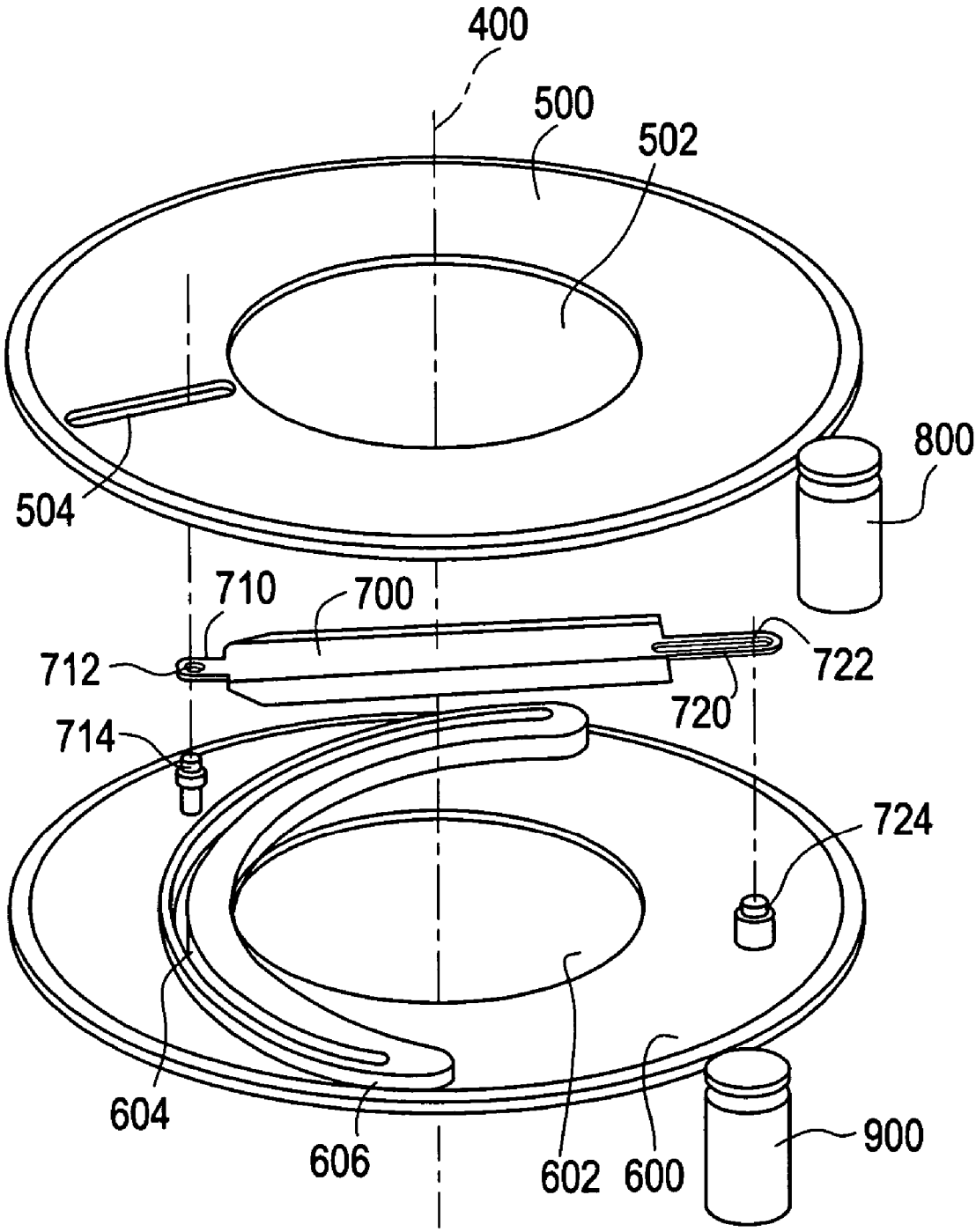
FIG. 2 is a diagram showing the construction of a beam diaphragm according to another example of the best mode for carrying out the present invention.

FIG. 2 is an exploded diagram showing the construction of a main portion of the beam diaphragm 4. This beam diaphragm is an example of the best mode for carrying out the present invention. By the construction of this beam diaphragm there is shown an example of the best mode for carrying out the present invention related to the beam diaphragm.

As shown in the same figure, the beam diaphragm 4 includes a first control ring 500 and a second control ring 600 which are opposed in parallel to each other spacedly along an axis 400. The axis 400 coincides with the axis of an X-ray beam. The first control ring 500 and the second control ring 600 are constructed of an X-ray absorbing material such as, for example, tungsten (W), molybdenum (Mo), or lead (Pb).

The first control ring 500 and the second control ring 600 are discs having a first aperture 502 and a second aperture 602, respectively, which are circular in shape. The first and second apertures 502, 602 are concentric circles in the first and second control rings 500, 600, respectively. The first and second apertures 502, 602 are of the same radius and have the axis 400 in common.

The first control ring 500 and the second control ring 600 have a first groove 504 and a second groove 604, respectively. The first groove 504 perpendicularly pass through the plate surface, in an outside of the first aperture 502. A longitudinal direction of the first groove 504 corresponds to the radial direction of the first control ring 500.

The second groove 604 is formed outside the second aperture 602, describing a circular arc having a curvature larger than the circumference of the second aperture. The second groove 604 is formed in an arcuate rail 606 provided on a surface (hereinafter referred to as the "inner surface") opposed to the first control ring 500.

Figure 3:
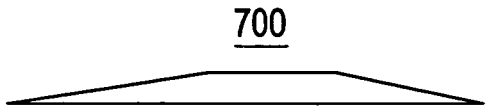
FIG. 3 is a diagram showing a cross section of a blade.

A blade 700 is provided between the first control ring 500 and the second control ring 600. The blade 700 is also constructed of an X-ray absorbing material. The blade 700 is a generally rectangular plate. A planar shape of the blade 700 is symmetric right and left with respect to a center line. The thickness of the blade 700, as shown in a cross-sectional view of FIG. 3, decreases gradually toward both right and left sides. Inclination of the decrease is asymmetrical.

The blade 700 has at both ends thereof extending portions 710 and 720 of different lengths. The extending portion 710, which is the shorter, has a hole 712 formed perpendicularly through the plate surface thereof. The extending portion 720, which is the longer, has a slot 722 formed through the plate surface thereof. A longitudinal direction of the slot 722 corresponds to the longitudinal direction of the extending portion 720.

A first pin 714 is fitted through the hole 712. Both ends of the first pin 714 are fitted in the first groove 504 of the first control ring 500 and the second groove 604 of the second control ring 600, respectively.

A second pin 724 is fitted through the slot 722. The second pin 724 is provided on the inner surface of the second control ring 600 on the side opposite to the second groove 604 with respect to the axis 400.

Figure 4:
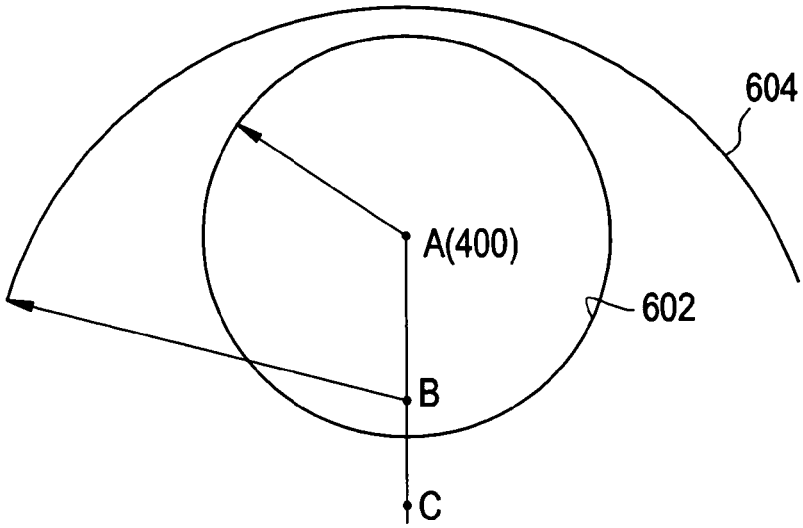
FIG. 4 is a diagram showing the geometry of a beam diaphragm.

Such a geometrical relation is shown in FIG. 4. In the same figure, the reference mark A denotes the axis 400, B denotes the center of curvature, and C denotes the center of the second pin 724. A central position of the second pin 724 lies on an extension line of line AB to B side.

Figure 5:
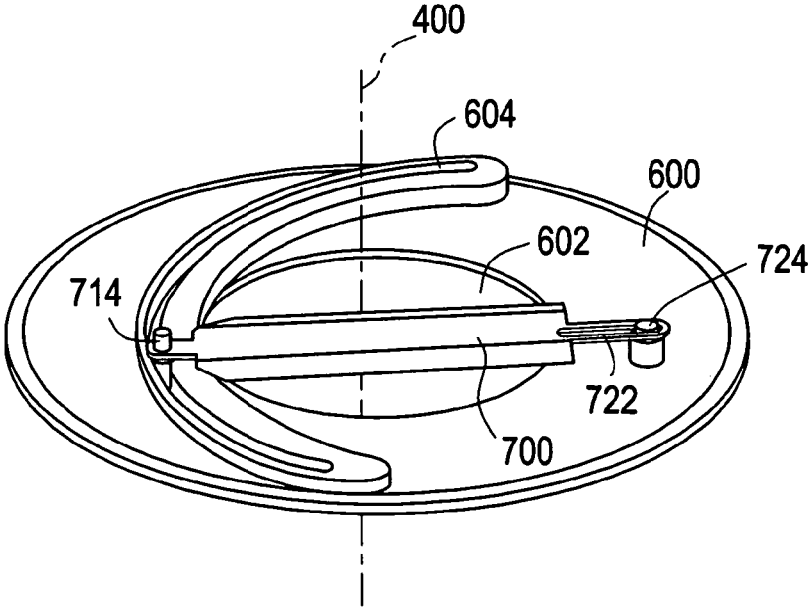
FIG. 5 is a diagram showing a partial construction of the beam diaphragm.
Figure 6:
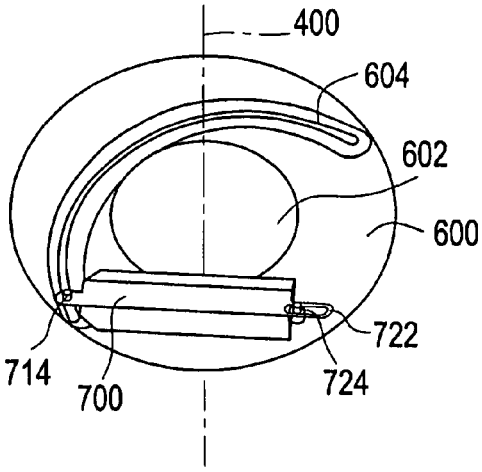
FIG. 6 is a diagram showing a sweep position of the blade.
Figure 7:
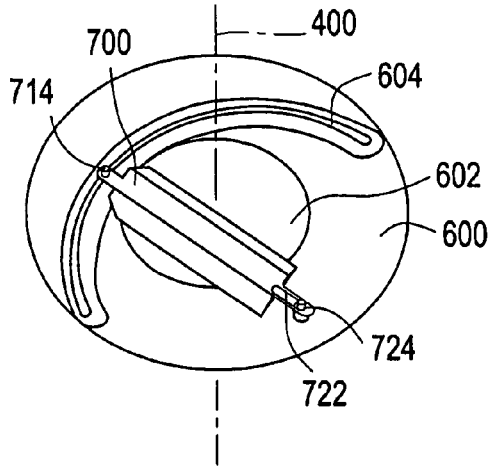
FIG. 7 is a diagram showing a sweep position of the blade.
Figure 8:
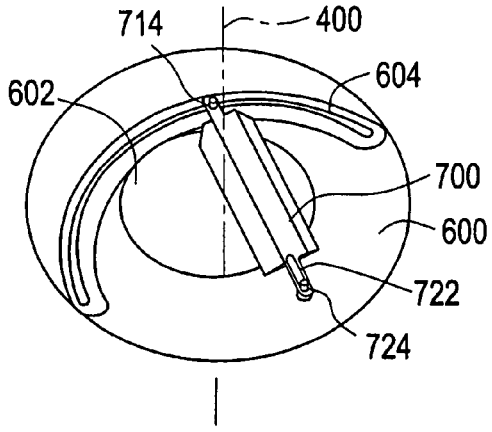
FIG. 8 is a diagram showing a sweep position of the blade.
Figure 9:
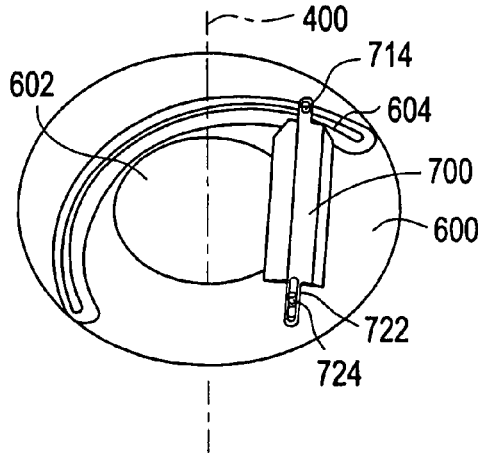
FIG. 9 is a diagram showing a sweep position of the blade.
Figure 10:
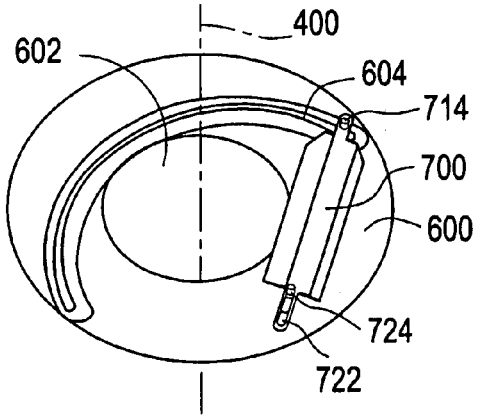
FIG. 10 is a diagram showing a sweep position of the diagram.

FIG. 5 shows in what state the blade 700 is secured to the second control ring 600. As shown in the same figure, the blade 700 is secured to the second control ring 600 while one end side thereof utilizes the engagement between the first pin 714 and the second groove 604 and the opposite end side thereof utilizes the engagement between the slot 722 and the second pin 724. The first control ring 500 with the first groove 504 engaged to the first pin 714 is applied over the second control ring 600 with the blade 700 mounted thereon.

The first control ring 500 and the second control ring 600 are rotatable independently of each other about the common axis 400 by means of a first motor 800 and a second motor 900, respectively.

When there is a difference between the rotational speed of the first control ring 500 and that of the second control ring 600, both rotate in a relative manner. It can be said that the first control ring 500 rotates with respect to the second control ring 600. Alternatively, it can be said that the second control ring 600 rotates with respect to the first control ring 500.

Assuming that the first control ring 500 rotates with respect to the second control ring 600, the first pin 714 is displaced along the second groove 604 with rotation of the first control ring 500, whereby the blade 700 rotates around the second pin 724. With this rotation, the blade 700 sweeps so as to describe a sectorial plane with the second pin 724 as the pivot.

The portion including the first groove 504, extending portion 710, hole 712, first pin 714, second groove 604, extending portion 720, slot 722 and second pin 724 is an example of the position adjusting means in the present invention.

Sweeping states of the blade 700 are shown in FIGS. 6 to 10. These figures show successive movements of the blade 700 with clockwise rotation of the first control ring 500, provided the first control ring 500 is omitted.

As shown in these figures, the blade 700 sweeps from left to right so as to describe a sectorial plane with the second pin 724 as the pivot along the second groove 604.

At this time, since the rotational center of the blade 700, i.e., the center C of the second pin 724 lies farther than the curvature center B of the second groove 604 with respect to the axis 400, as shown in FIG. 4, so that the distance from the rotational center C to the second groove 604 varies depending on the sweep position. This change of distance appears as a positional change of the second pin 724 in the slot 722 of the blade 700.

Figure 11:
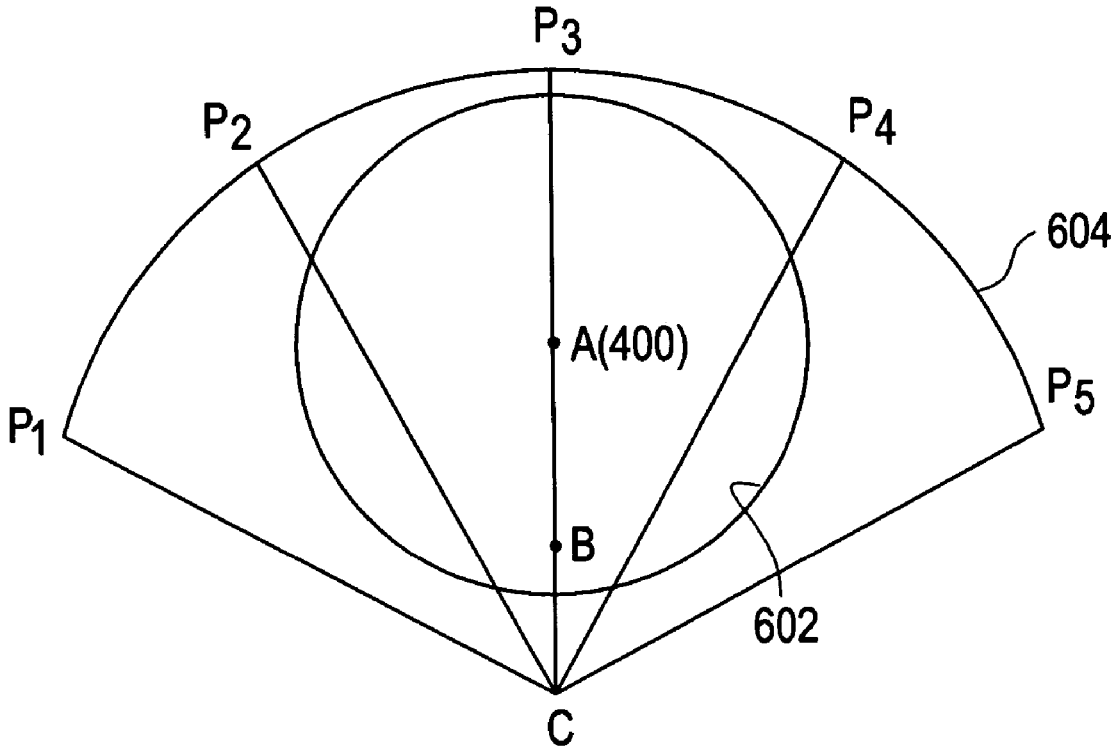
FIG. 11 is a diagram showing how radius changes with sweep of the blade.

FIG. 11 is a conceptual diagram of such sweep. In the same figure, p1 to p5 represent positions of the first pin 714 in the second groove 604 in the sweep process. More specifically, p1 and p5 represent left- and right-end positions, respectively, of the second groove 604, p3 represents a central position, and p2 and p4 represent intermediate positions respectively from the left and right ends up to the central position.

The distance from the rotational center C to the second groove 604 is the shortest when the first pin 714 lies at the left end p1 or the right end p5 of the second groove 604, is the longest when the first pin 714 lies at the center p3 of the second groove 604, and is a distance intermediate between both distances when the first pin 714 lies at the intermediate positions p2 and p4.

That is, from both right and left ends to the center of the second groove 604, the blade 700 sweeps so as to describe a sectorial plane whose radius increases gradually, while from the center to both right and left ends of the second groove 604 the blade 700 sweeps so as to describe a sectorial plane whose radius decreases gradually.

The direction from both ends to the center of the second groove 604 is the direction of approaching the axis 400, while the direction from the center to both ends of the second groove 604 is the direction of leaving the axis 400. Thus, the blade 700 moves in the direction of approaching or leaving the axis 400 of the apertures so as to describe a sectorial plane whose radius increases or decreases continuously.

Figure 12:
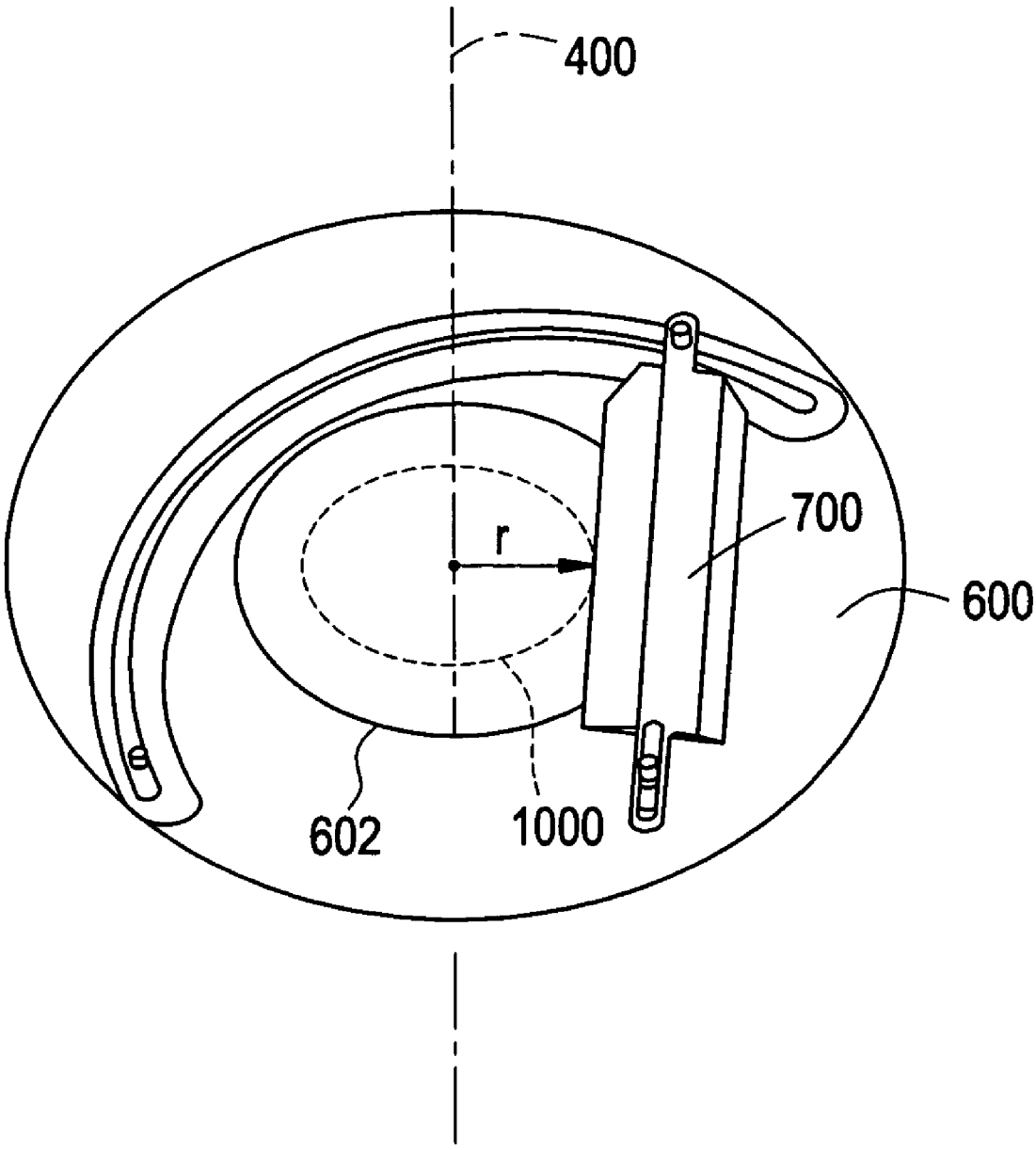
FIG. 12 is a diagram showing an effective aperture.

When the sweep position of the blade 700 has reached a desired position, the rotational speed of the first control ring 500 and that of the second control ring 600 are made equal to each other. As a result, the relative rotation of the first control ring 500 stops and the blade 700 stays in its position shown in FIG. 12 for example.

In this state both first and second control rings 500, 600 rotate at an equal speed, so that the blade 700 rotates around the axis 400. Consequently, the area through which X-rays can pass without being obstructed by the blade 700 is a circular area indicated with a broken line in the same figure. This circular area corresponds to an effective aperture 1000 of the beam diaphragm.

The radius of the effective aperture 1000 is given in terms of the length of a perpendicular dropped from the axis 400 to an edge of the blade 700. This length varies depending on the sweep stop position of the blade 700. Thus, the beam diaphragm 4 is a variable aperture type beam diaphragm.

The closer to the edge of the blade 700, the thinner the blade, and the amount of absorbed X-rays decreases (the amount of transmitted X-rays increases) accordingly. Therefore, outside the effective aperture 1000, a gradation is given such that the closer to the effective aperture 1000, the higher the intensity of transmitted X-rays. Since the thickness decreasing inclination is made different between the right and the left portion of the blade 700, the gradation can be used properly according to the purpose.

Figure 13:
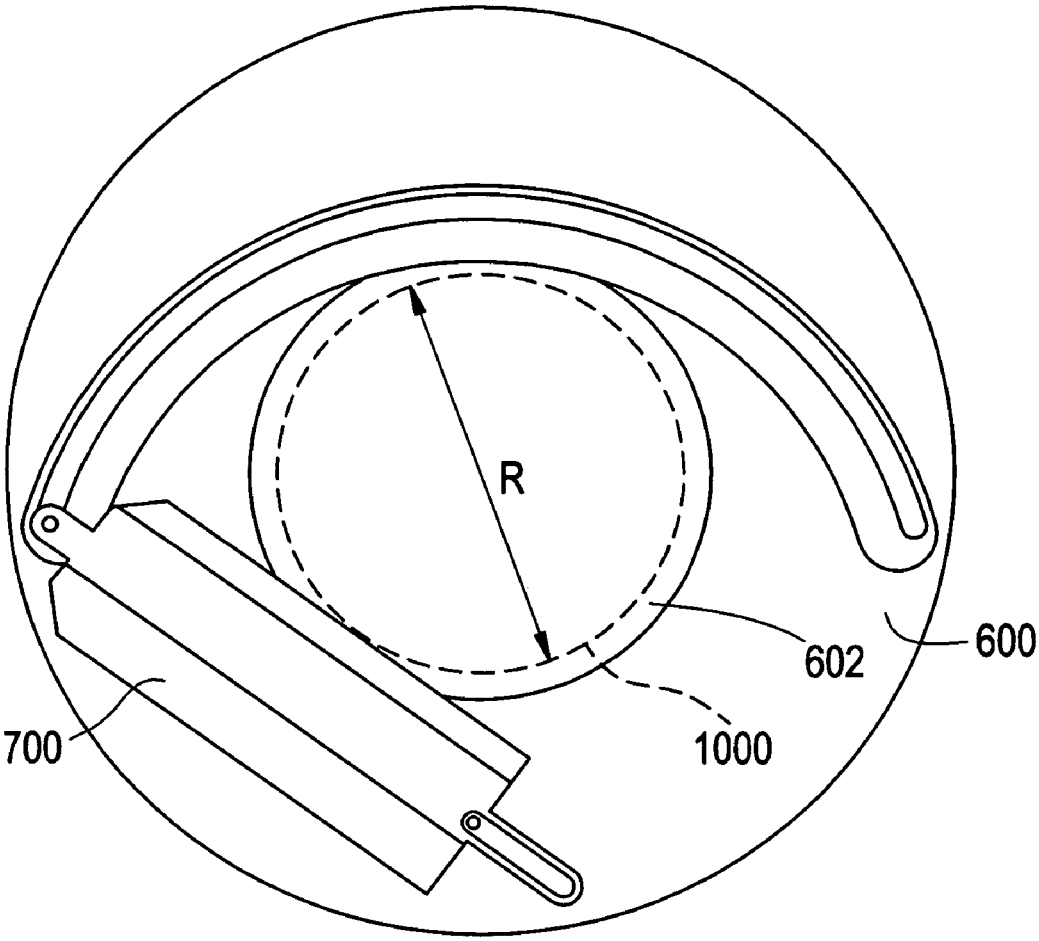
FIG. 13 is a diagram showing a maximum value of an effective aperture.

The effective aperture 1000 becomes maximum when the blade 700 is retracted to a maximum extent. This state is shown in FIG. 13. As shown in the same figure, the blade 700 lies in a position in which the greater part of the blade is retracted from the second aperture 602, with only a part of its edge overlapping the second aperture 602. At this time, the effective aperture 1000 becomes a circular area of a diameter R, as indicated with a broken line.

The diameter R, i.e., a maximum value, of the effective aperture 1000 can be made as large as possible by increasing the amount of retraction of the blade 700 to diminish the portion overlapping the second aperture 602.

However, trade-off is needed because protruding of the blade 700 to the outside of the second control ring 600 must be avoided.

On this regard, as shown in FIG. 11, since the beam diaphragm 4 is constructed so that the radius of a sectorial plane formed by sweeping of the blade 700 is the shortest at both ends, the portion overlapping the second aperture 602 can be diminished while preventing protrusion of the blade 700 to the outside of the second control ring 600. Thus, the maximum value of aperture opening can be made larger under a limited profile dimension.

That a planar shape of the blade 700 is symmetric right and left with respect to a center line also facilitates enlarging the maximum value of aperture opening under a limited profile dimension. This is because if the planar shape of the blade is made asymmetric right and left, the wider side overlapping the second aperture 602 becomes larger and eventually the maximum value of opening of the effective aperture 1000 decreases.

Many widely different embodiments of the invention may be configured without departing from the spirit and the scope of the present invention. It should be understood that the present invention is not limited to the specific embodiments described in the specification, except as defined in the appended claims.

The invention claimed is:

1. A beam diaphragm comprising:

a pair of control rings having coaxial apertures for the passage of X-rays therethrough, the pair of control rings being opposed to each other axially through a spacing and coaxially rotatable independently of each other;

a blade positioned between the pair of control rings; and a position adjusting device including a first pin moveably engaging a slot extending through a first end of the blade, wherein, in accordance with a relative rotation of the pair of control rings, the position adjusting device causes the blade to move toward or away from a common axis of the apertures so as to describe a sectorial plane having a radius that increases or decreases continuously, wherein the radius is defined by a distance between a second end of the blade and the first pin.

2. A beam diaphragm according to claim 1, wherein the position adjusting device further comprises:

a first groove radially formed outside the aperture in one of the pair of control rings;

a second groove arcuately formed outside the aperture in the other control ring and a second pin for bringing the second end of the blade into engagement with the first and second grooves simultaneously.

3. A beam diaphragm according to claim 1, wherein a planar shape of the blade is symmetrical with respect to a center line.

4. A beam diaphragm according to claim 3, wherein the thickness of the blade decreases gradually toward both right and left sides.

5. A beam diaphragm according to claim 4, wherein the decrease in thickness of the blade is asymmetrical.

6. An X-ray imaging apparatus for photographing a radioscopic image by radiating X-rays emitted from an X-ray source to a subject through apertures of a beam diaphragm, the beam diaphragm comprising:

a pair of control rings having coaxial apertures for the passage of X-rays therethrough, the pair of control rings being opposed to each other axially through a spacing and coaxially rotatable independently of each other;

a blade positioned between the pair of control rings; and a position adjusting device including a first pin moveably engaging a slot extending through a first end of the blade, wherein, in accordance with a relative rotation of the pair of control rings, the position adjusting device causes the blade to move toward or away from a common axis of the apertures so as to describe a sectorial plane whose radius increases or decreases continuously, wherein the radius is defined by a distance between a second end of the blade and the first pin.

7. An X-ray imaging apparatus according to claim 6, wherein the position adjusting device further comprises:

a first groove radially formed outside the aperture in one of the pair of control rings;

a second groove arcuately formed outside the aperture in the other control ring and a second pin for bringing the second end of the blade into engagement with the first and second grooves simultaneously.

8. An X-ray imaging apparatus according to claim 6, wherein a planar shape of the blade is symmetrical with respect to a center line.

9. An X-ray imaging apparatus according to claim 8, wherein the thickness of the blade decreases gradually toward both right and left sides.

10. An X-ray imaging apparatus according to claim 9, wherein the decrease in thickness of the blade is asymmetrical.

* * * * *

UNITED STATES PATENT AND TRADEMARK OFFICE

CERTIFICATE OF CORRECTION

PATENT NO. : 7,263,171 B2
APPLICATION NO. : 11/243696
DATED : August 28, 2007
INVENTOR(S) : Zhang It is certified that error appears in the above-identified patent and that said Letters Patent is hereby corrected as shown below:

In Claim 2, column 6, line 56, delete "control ring and" insert therefor -- control ring; and --.

Signed and Sealed this

Seventeenth Day of June, 2008

JON W. DUDAS
*Director of the United States Patent and Trademark Office*